United States Patent [19]

Bavaveas

[11] Patent Number: 4,709,425

[45] Date of Patent: Dec. 1, 1987

[54] HOLDER FOR A TOILET CLEANING PRODUCT ASSOCIATED WITH AN AIR DEODORIZER

[75] Inventor: Tristan Bavaveas, Paris, France

[73] Assignee: Eparco, Paris, France

[21] Appl. No.: 919,329

[22] Filed: Oct. 15, 1986

[30] Foreign Application Priority Data

Oct. 16, 1985 [FR] France ..... 85 15358

[51] Int. Cl.[4] ..... E03D 9/02; B65D 53/06

[52] U.S. Cl. ..... 4/228; 4/227; 215/227; 220/228

[58] Field of Search ..... 4/227, 228; 220/23; 215/227, 228; 206/233, 229, 581

[56] References Cited

U.S. PATENT DOCUMENTS

| | | | |
|---|---|---|---|
| 2,766,796 | 10/1956 | Tupper | 220/23 |
| 2,802,590 | 8/1957 | Tupper | 220/23 |
| 3,499,526 | 3/1970 | Willinger | 220/23 |
| 3,874,007 | 4/1975 | Dolan | 4/228 |
| 4,189,793 | 2/1980 | Williamson et al. | 4/228 |
| 4,522,298 | 6/1985 | Weinberger | 220/23 X |
| 4,618,444 | 10/1986 | Hudson et al. | 215/227 X |
| 4,636,328 | 1/1987 | Flynn et al. | 215/227 X |

*Primary Examiner*—Henry K. Artis
*Attorney, Agent, or Firm*—Fred A. Keire

[57] ABSTRACT

A holder for a toilet cleaning product including a container for the cleaning product, such as a perfumed liquid; a pre-use and pre-assembly closure member, such as a plug, for the container; and a member for securing the container to the toilet; an air deodorizer is provided which is physically separable from the holder closure member but adapted to operate in combination therewith so that, with the holder and deodorizer in the inoperative state, the closure member not only seals the container but also seals and integrally retains the deodorizer.

7 Claims, 5 Drawing Figures

HOLDER FOR A TOILET CLEANING PRODUCT ASSOCIATED WITH AN AIR DEODORIZER

The invention relates to a holder for a holder for a toilet cleaning product associated with an air deodorizer.

Holders for toilet cleaning products are known which usually comprise: a container for the cleaning product; a pre-use and pre-assembly closure member for the container; and a member for securing the container to the toilet. More particularly, a holder is known which is adapted to receive a perfumed coloured cleaning liquid and which is receivable in a toilet flushing system and adapted to output a metered quantity of cleaning liquid when the toilet flush is operated. In this case the container is a bottle which has a neck receiving metering means comprising a flap or float or the like. the securing element enables the bottle to be so retained that its neck extends downwardly in the flushing system in operation. The closure member is usually a plug screwed to external screwthreading of the bottle neck, the plug protecting the metering or dispensing means and ensuring that the cleaning liquid is not spilt before use. Holders of this kind are disclosed, for example in U.S. Pat. Spec. Nos. 3,908,209, 3,806,965, 3,895,739, 3,698,821, and 3,841,524. Basically, the perfume of the cleaning liquid evolves when the flushing system is operated but does not evolve between two consecutive flushes. Also, some of the delivered liquid dose is usually lost in the toilet when the flushing water is discharged. If the room where the toilet is disposed is very large, the perfume evolved by the discharge of flushing liquid is too small to provide complete deodorization. Consequently, holders of this kind which dispense a perfumed liquid cannot provide permanent deodorization of the room where the toilet is disposed.

Permanent deodorizing devices are also known (French patent specification No. 2 464 719). However, the containers of such devices are usually complex to make sure of pre-use sealing tightness. Also, the continuous or permanent feature of such devices is inadequate at the time when the toilet is used.

It is an object of the inventio to obviate these disadvantages; accordingly, it is a first object of the invention to enable both the toilet or the water of the toilet and the room where the toilet is disposed to be perfumed or deodorized. It is another object of the invention to provide a solution of the problem which is constructionally simple and simple to perform.

The invention accordingly proposes a holder for a toilet cleaning product, of the kind comprising: a container, such as a bottle, for the cleaning product, such as a perfumed liquid; a pre-use and pre-assembly closure member, such as a plug, for the container; and a member for securing the container to the toilet. The closure member of the holder comprises an air deodorizer which is physically separable from the holder but adapted to operate in combination therewith so that, with the holder and deodorizer in the inoperative state, the closure member is operative not only to seal the holder but also to seal and internally retain the deodorizer.

According to other features, the closure member has on its transverse end wall reliefs, notably intaglio reliefs, with which the free edge of a skirt of a plug of the deodorizer so co-operates as to locate the same properly and provide some retention thereof on the holder closure member. In the inoperative state means are provided for producing a rigid, hermetic and releasable association between the deodorizer and the holder closure member. Such means take the form, for example, of a plastics sheath. The cleaning product and the deodorizing substance evolve the same perfume and their quantities are such that, assuming normal average use of the toilet, they are consumed approximately over the same period of time as one another and can therefore be replaced together.

Other features of the invention will become apparent from the following description, reference being made to the accompanying drawings wherein.

Figure 1:
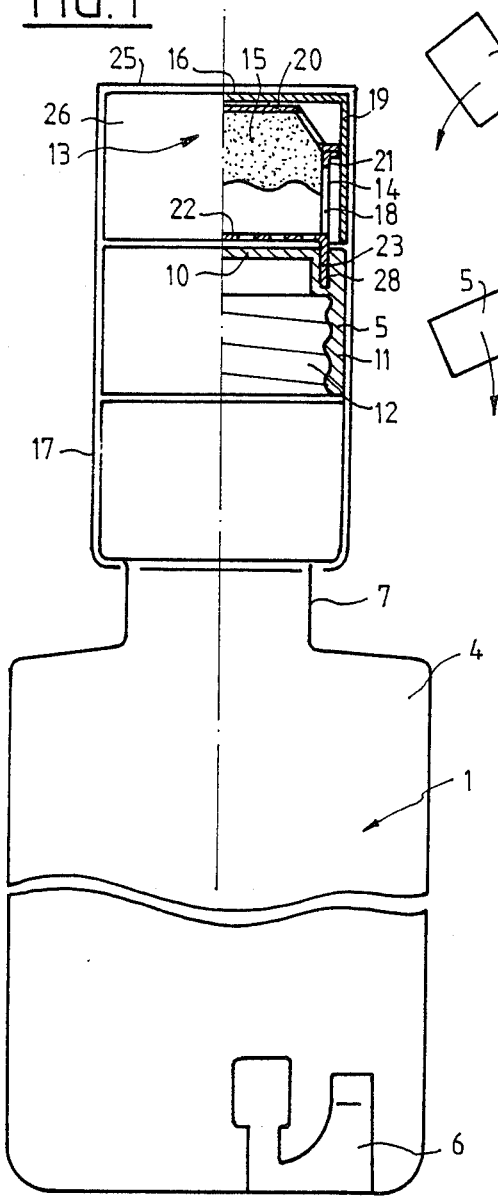
FIG. 1 is a diagrammatic view in elevatio of the holder according to the invention with the associated deodorizer, the whole being in the inoperative state, the illustration showing partly and in section a first constructional variant.

The invention relates to a holder 1 delivering a cleaning product 2 for a toilet 3, of the kind comprising a container 4 for the product 2, a preuse and pre-assembly closure member 5 of the container 4 and a member 6 for securing the container 4 to the toilet 3.

Preferably, the invention is of use more particularly when the holder 1 is of use for a perfumed liquid cleaning product which may perform other duties than those of a detergent and which is discharged in consecutive and spaced-apart doses when flushing system 3*a* of the toilet 3 is operated. In this event the container 4 is a bottle comprising a neck 7 receiving metering or dispensing means 8, notably of the flap or float or some other kind but not directly forming part of this invention. When the holder 1 is to be operative, a securing member 6 enables the bottle 4 to be secured with its neck 7 directed downwardly and immersed in the water of the flushing system 3*a* when the same is full. The metering means 8 deliver a dose of cleaning liquid 2 at each operation of the flushing system because of the water level 9 therein dropping as a result of such operation. The member 5 is in such cases usually a screw-on plug comprising a transverse end wall 10 and, adjacent the same and integral therewith, a side skirt 11 formed on its inside surface with screwthreading 12 or bossing or the like co-operating with matching screwthreading or bossing or a recess in the neck 7. However, the plug 5 can be of a different kind, notably of the kind adapted to be force fitted.

According to the invention, the holder closure member 5 is associated when in the inoperative state —i.e., more particularly for sales presentation, sale, storage and transport—i.e., before use—with an air deodorizer 13 which in the operative state can be separated physically from the holder 1 so as to be able to operate in combination with the holder 1. With the holder 1 and the deodorizer 13 in the inoperative state, the closure member 5 not only seals the container 4 but also seals the deodorizer 13 and keeps the elements 13, 1 together.

The deodoriser 13 mainly comprises a container 14 containing a deodorizing substance 15 and releasable securing means 16.

The deodorizing substance 15 is in a non-flowing form and is inter alia in the form of a gel or in the form of a perfumed product used to impregnate a porous or fibrous or similar support substance. The deodorizing substance 15 is basically perfumed with a perfume identical or similar to the perfume of the cleaning product 2. The releasable securing means 16 are, for example, a double-sided adhesive foil or film or the like whose external surface is protected in the unused state by a tear-off protective film or foil or the like.

The deodorizer 13 can be in one of two states —the inoperative state in which it is unused, for example, when presented for sale or stored or transported, and an operative state in which it is used for air deodorization.

In the inoperative state the deodorizer 13 is physically and non-movably, but releasably, so associated with the closure member 5 that the system embodied by the holder 1 and deodorizer 13 is a unitary whole and the substance 15 is sealed hermetically. This inoperative state of the deodorizer 13 also corresponds to the inoperative—i.e., unused—state of the holder 1.

In the operative state the deodorizer 13 is so dissociated from the closure member 5 as to be placed in any desired position relatively far away from the holder 1 and as to be opened for continuous evolution of the perfume of the substance 15. With the deodorizer 13 in the operative state, the holder 1 is preferably in the operative state—i.e., used or possibly remaining temporarily in the inoperative state.

The term "operative state of the holder 1" denotes the state in which the holder 1 is ready to operate whether it is or is not actually operating. In this state the member 5 is removed from the container 4. In the case of a holder 1 for a cleaning liquid product, the bottle 4 is in this situation positioned with the neck 6 at the bottom in the flushing system 3*a*. In this situation and with this variant the holder 1 can deliver doses of cleaning liquid 2 of each operation of the flushing 3*a*.

On the other hand, the term "inoperative state of the holder 1" refers to the state in which the holder 1 cannot operate since the closure member 5 closes the container 4.

According to the invention, there are further provided in the inoperative state means 17 for providing a rigid and hermetic but releasable physical association between the deodorizer 15 and the closure member 5.

Preferably, the means 17 are embodied by a stretch or heat-shrink plastics sheet which extends around the elements 5, 13.

Figure 5:
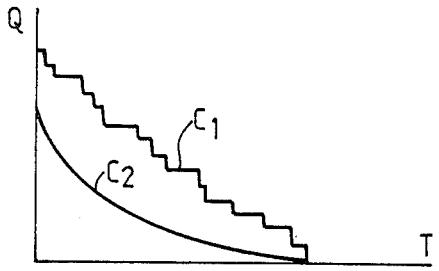
FIG. 5 is a graph showing the progressive consumptions of cleaning product and deodorizing substance respectively.

According to the invention, the quantity of cleaning product 2 and the quantity of deodorizing substance 15 are such that for normal average operation of the flushing system 3*a* and for normal average conditions of siting of the toilet 3*a* in the room where the deodorizer 13 is to be used, the cleaning product 2 and the deodorizing substance 15 are consumed approximately over the same period of time as one another and can therefore be replaced together. This feature is shown more particularly in FIG. 5 which is a graph in which the time T is plotted along the abscissae and the quantities are plotted along the ordinates. The curve C1 corresponds to the cleaning product 2 and the curve C2 to the deodorizing substance 15. The curve C1 has the general shape of a stairway and is notably straight overall as a whole, the height of each tread of the stairway corresponding to one dose of product. Of course the curve C1 depends upon the use made of the flushing system 3*a*. The curve C2 is regular and continuous and corresponds to use of the deodorizing substance 15. As will be apparent, the two curves meet at zero quantity of product 2 and substance 15 substantially at the end of the same period of time. In practice, of course, the periods of time may vary in dependence upon actual use of the flushing system 3*a*, the size of the room where the toilet 3 is sited and so on. Preferably, this period of time is of the order of two months.

Two possible but non-limitative embodiments of the inventio will be described hereinafter with reference to the case in which the holder 1 is adapted to deliver doses of cleaning product 2 in liquid form. In this case the holder 1 comprises, as previously stated, a bottle 4 having a neck 7, metering means 8 disposed therein and a plug 5.

Figure 2:
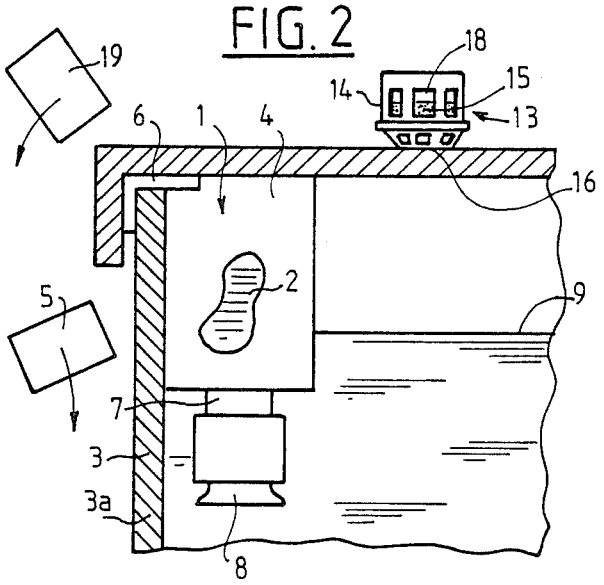
FIG. 2 is a diagrammatic view in section and in elevation showing how the holder according to the invention can be used.
Figure 3:
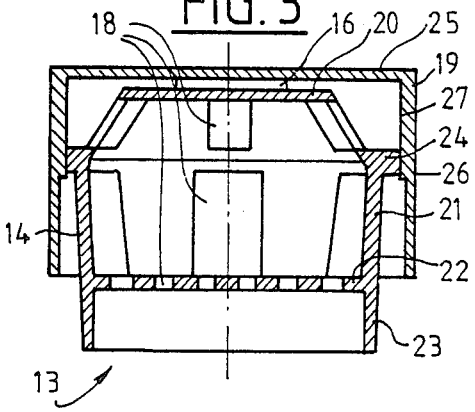
FIG. 3 is a diagrammatic view in axial section of a first preferred variant of the deodorizer according to the invention.

In a first and preferred embodiment shown in FIGS. 1, 2 and 3, the deodorizer 13 comprises a container 14 formed with perforations 18 and receiving the deodorizing substance 15. The perfume thereof can evolve through the perforations 18. The deodorizer 13 also comprises a plug in which the container 14 is received releasably. The plug 19 is adapted to be placed on and in extension of the plug 5, notably on the transverse end wall 10 thereof. In this case the plastics sheath embodying the means 17 can be so applied to the plugs 5, 19 s to interconnect them rigidly and mutually and hermetically but releasably.

Preferably, the container 14 has the general shape of a cylinder or pseudo-cylinder bounded by an end member 20, which is substantially solid, a side wall 21 and a front wall 22. The perforations 18 are present in the walls 21, 22. The front wall 22 is recessed so as to leave an edge of the side wall 21 clear. The container 14 can be in two separate parts usually interconnected inter alia by sticking or welding or other means and thus being adapted to receive in it the deodorizing substance 15. Alternatively, the side wall 21 has near the member 20 an outer annular projection 24 and the side wall 21 has a truncoconical shape between the member 20 and the projection 24. The double-sided adhesive film 16 is therefore positioned on the outside surface of the member 20.

The plug 19 comprises a transverse end wall 25 and, contiguous and unitary therewith, a side skirt 26. The inside surface thereof is formed with one or more axial projections 27 near the wall 25, the projections 27 enabling the container 14 to be retained in the plug 19 by way of the annular projection 24 and the axial projections 27, providing some relative clamping. When the container 14 is assembled in the plug 19, the outside surface of the member 20 where the double-sided film 16 is disposed is placed on the inside surface of the wall 25. The free edge 23 of the container 14 therefore projects from the skirt 26, the front wall 22 being at least substantially coplanar with the free edge of the skirt 26. An annular groove 28 with which the outside surface of the plug wall 10 is formed and which companions the free edge 23 of the container 14 ensures correct relative location and some retention of the deodorizer on the plug 5. The front wall 22 is therefore placed against the transverse end wall 10 of the plug 5 and the skirts 11, 26 are disposed in extension of one another. The sheath 17 can therefore be applied to the skirts 11, 26 and retained on the wall 25 and neck 7.

Figure 4:
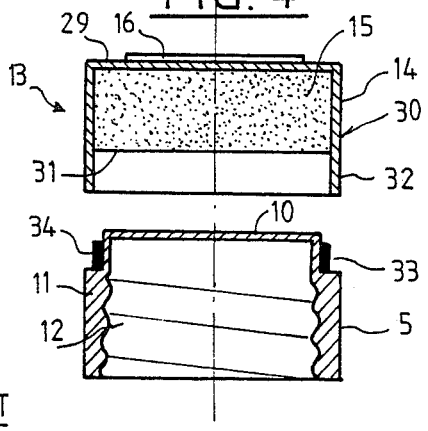
FIG. 4 is a diagrammatic view in section on an axial plane of a second constructional variant of the device according to the invention and of the plug of the holder with which the device is associated.

In a second embodiment, shown in FIG. 4, the device 13 comprises a plug-like container 14 having a transverse end wall 29 and a side skirt 30. The substance 15 is received in the resulting plug and the free or exposed surface 31 of the substance 15 is at a distance from the free edge 32 of the skirt 30. The plug 5 is formed with a peripheral annular groove 33 between the wall 10 and the skirt 11 with which the free edge 32 co-operates. If required, projections 34 of the side edge of the recess 33 co-operate with the skirt 30 for relative retention of the deodorizer 13 of the plug 5. Sealing tightness is provided because of the contact between the wall 10 and the exposed surface 31 of the deodorizing substance 15 and/or by means of the sheath 16 as previously defined.

In both embodiments the holder 1 and the deodorizer 13 have a main axis X—X of symmetry or revolution. However, the holder 1 and deodorizer 13 can, if necessary, be of asymmetrical shape.

As will be apparent from the foregoing, the closure member 5 has on its transverse end wall 10 reliefs 28, 33, inter alia intaglio reliefs, with which the free edge 23, 32 of a side wall 21 or of a side skirt 30 of a plug 19, 14 of the deodorizer 13 co-operates to provide correct location and some retention of the deodorizer 13 on the closure member 5.

As a rule, the holder 1 and the deodorizer 13 are used simultaneously. To this end, the means 17 are removed, whereafter the double-sided adhesive protection film 16 is removed and the deodorizer 13 is secured in any required position in the room where the toilet 3 is situated. The closure member 5 is removed, the container 4 is associated with the toilet 3 and inter alia the bottle 4 is positioned with the neck 7 extending downwards into the flushing system 3*a*. In the light of the respective quantities of cleaning product 2 and deodorizing substance 15, the product 2 and the substance 5 are, as previously mentioned, used up substantially over the same period of time.

I claim:

1. A holder for a toilet cleaning product comprising: a container for the cleaning product; a pre-use and pre-assembly closure member for the container; and a member for securing the container to the toilet; said closure member of the holder including an air deodorizer including a receptacle for a deodorizing substance and adhesive mans for releasably securing the deodorizer to the closure member, said deodorizer being physically separable from the holder but adapted to operate in conjunction therewith such that approximately the same amount of cleaning product and deodorizing substance are discharged over the same period of time; the closure member is adapted to integrally seal both the container and the deodorizer to define an inoperative state of the deodorizer; the closure member having on its transverse end walls a plurality of grooves which cooperatively engage projections extending downwardly from the deodorizer thereby retaining the deodorizer on the holder closure member in its desired position.

2. A holder according to claim 1 including a inoperative state means for producing a rigid, hermetic and releasable association between the deodorizer and the holder closure member.

3. A holder according to claim 1 wherein the inoperative state means is a sheath which is made of a heat-shrinkable stretch plastics and which extends around the holder closure member and the deodorizer.

4. A holder according to any of claim 1 wherein the receptacle of the deodorizer is perforated and receives the deodorizing substance; and a plug receiving the receptacle, the securing means being disposed on the outside surface of the base of the container.

5. A holder according to claim 4 wherein the receptacle includes a plane base, a side wall and a front wall, the side and front walls being perforated.

6. A holder according to claim 4 wherein a free edge of the side wall of the container projects from the skirt of the plug which receives the container, the free edge cooperating with a groove in the closure member.

7. A holder according to claim 1 wherein the deodorizer includes a plug-like receptacle in which the deodorizing substance is received, the exposed surface thereof leaving an edge of the skirt free, such edge cooperating with a recess in the closure member.

* * * * *